US007890020B2

(12) United States Patent
Chang et al.

(10) Patent No.: US 7,890,020 B2
(45) Date of Patent: Feb. 15, 2011

(54) ORGANIC PHOTOCONDUCTOR DRUM

(75) Inventors: Yuing Chang, Taipei (TW); Chung-Shin Liu, Taipei (TW); Hung-Huang Tai, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 63 days.

(21) Appl. No.: 12/379,132

(22) Filed: Feb. 13, 2009

(65) Prior Publication Data

US 2010/0008697 A1 Jan. 14, 2010

(30) Foreign Application Priority Data

Jul. 8, 2008 (CN) ..... 2008 1 0029409

(51) Int. Cl.
*G03G 15/00* (2006.01)

(52) U.S. Cl. ..... 399/116; 399/162

(58) Field of Classification Search ..... 399/116, 399/117, 162, 107
See application file for complete search history.

(56) References Cited

U.S. PATENT DOCUMENTS

| | | | | |
|---|---|---|---|---|
| 6,308,025 | B1 * | 10/2001 | Okano et al. | 399/107 |
| 6,356,725 | B1 * | 3/2002 | Park et al. | 399/116 |
| 6,535,704 | B1 * | 3/2003 | Hoyt et al. | 399/116 |
| 6,928,251 | B2 * | 8/2005 | Yoshihara et al. | 399/107 |
| 2008/0069591 | A1 * | 3/2008 | Lai et al. | 399/162 |

* cited by examiner

*Primary Examiner*—Sophia S Chen
(74) *Attorney, Agent, or Firm*—Rosenberg, Klein & Lee

(57) ABSTRACT

An organic photoconductor (OPC) drum includes a support member formed as a unitary molded body, a pair of mounting members, a pair of rollers, and an OPC belt. The support member includes a plurality of support plates, a plurality of groove-defining U-shaped segments, and first and second sidewalls. Each of the support plates extends in a first direction. Adjacent ones of the support plates are spaced apart from each other in a second direction transverse to the first direction. Each of the U-shaped segments interconnects a corresponding adjacent pair of the support plates. Each of the mounting members is coupled to a respective one of the first and second sidewalls. The rollers flank the support member in the second direction. The OPC belt is trained on an assembly of the support member and the rollers, and is driven by the rollers to move on the support plates.

9 Claims, 6 Drawing Sheets

ORGANIC PHOTOCONDUCTOR DRUM

CROSS-REFERENCE TO RELATED APPLICATION

This application claims priority of Chinese Patent Application No. 200810029409.0, filed on Jul. 08, 2008.

BACKGROUND OF THE INVENTION

1. Field of the Invention

The invention relates to an organic photoconductor (OPC) drum, more particularly to improvements relating to the structure of an organic photoconductor (OPC) drum.

2. Description of the Related Art

FIGS. 1 and 2 show a conventional organic photoconductor (OPC) drum that is used in a laser printer and that has a support member 9 extending in a first direction, a pair of mounting members (only one is shown in FIG. 2), a pair of rollers 97, and an OPC belt 95. The support member 9 includes four aluminum brackets 91, two metal clamps 92, and two plastic spacers 93, all of which are assembled onto an aluminum frame 94.

The rollers 97 flank the support member 9 in a second direction transverse to the first direction. The OPC belt 95 is trained on an assembly of the support member 9 and the rollers 97, and is driven by the rollers 97 to move on the brackets 91 of the support member 9. Since the brackets 91 are set up to support the OPC belt 95, a uniform surface finish across the support member 9 is thus desirable, which requires a high degree of precise manufacturing.

Another setback associated with the aforementioned conventional structure relates to the tolerance control of assembling many components (i.e., brackets 91, clamps 92, spacers 93, frame 94) together. Also, such assembly requires use of various fixtures or tools, which increases the production cost.

SUMMARY OF THE INVENTION

Therefore, it is an object of the present invention to provide an organic photoconductor drum that can overcome the above drawbacks of the prior art.

According to the present invention, an organic photoconductor (OPC) drum according to the present invention includes a support member formed as a unitary molded body, a pair of mounting members, a pair of rollers, and an OPC belt. The support member includes a plurality of support plates, a plurality of groove-defining U-shaped segments, and first and second sidewalls. Each of the support plates extends in a first direction and has opposite first and second ends. Adjacent ones of the support plates are spaced apart from each other in a second direction transverse to the first direction. Each of the U-shaped segments extends in the first direction, has opposite first and second ends, and interconnects a corresponding adjacent pair of the support plates. The first sidewall is connected to the first end of the support plates and the first end of the U-shaped segments. The second sidewall is connected to the second end of the support plates and the second end of the U-shaped segments.

The mounting members are opposite to each other in the first direction. Each of the mounting members is coupled to a respective one of the first and second sidewalls. The rollers flank the support member in the second direction. Each of the rollers extends in the first direction and has opposite ends coupled to the mounting members, respectively. The OPC belt is trained on an assembly of the support member and the rollers, and is driven by the rollers to move on the support plates of the support member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
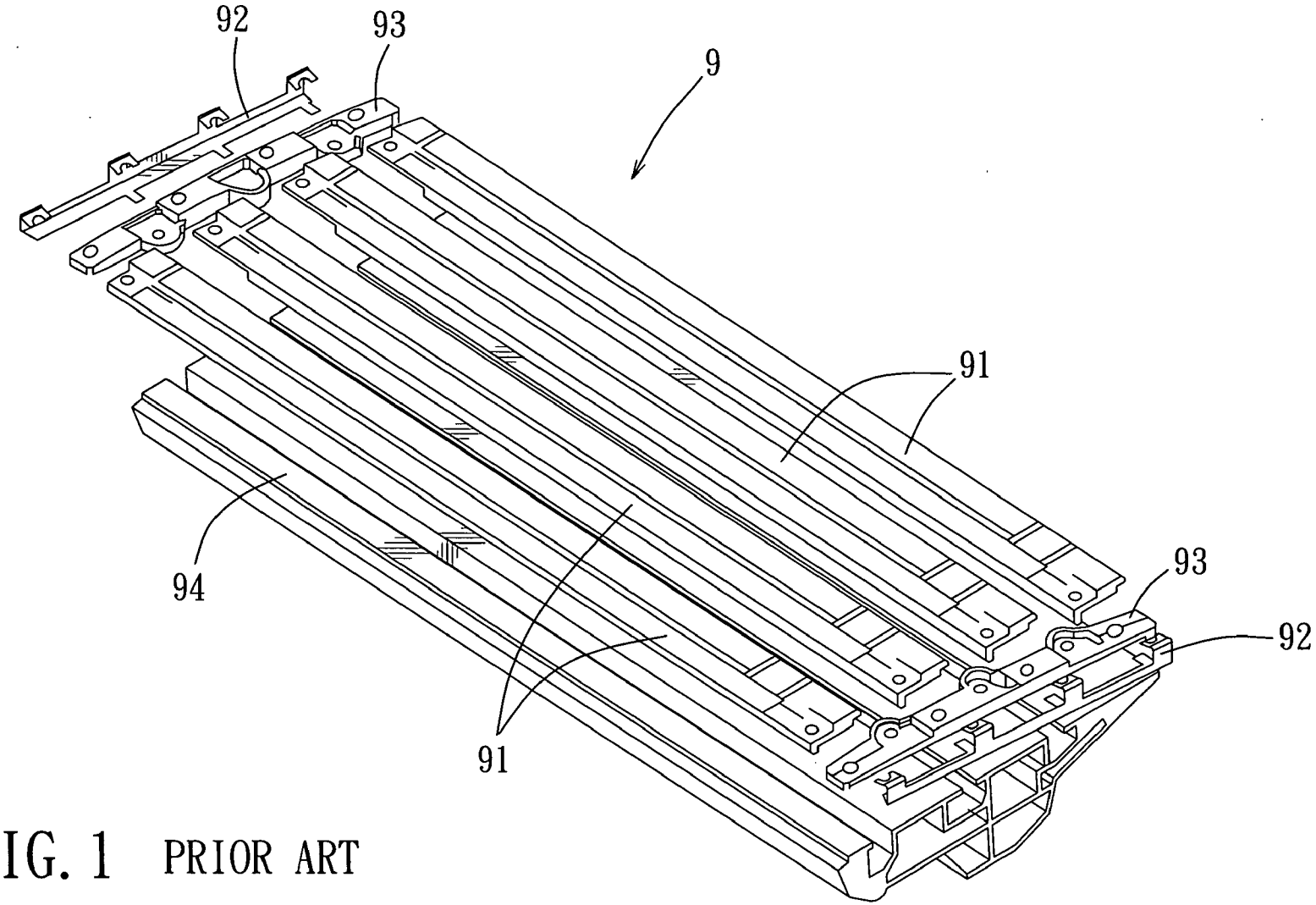
FIG. 1 PRIOR ART
FIG. 1 is an exploded perspective view of a support member of a conventional organic photoconductor (OPC) drum.
Figure 2:
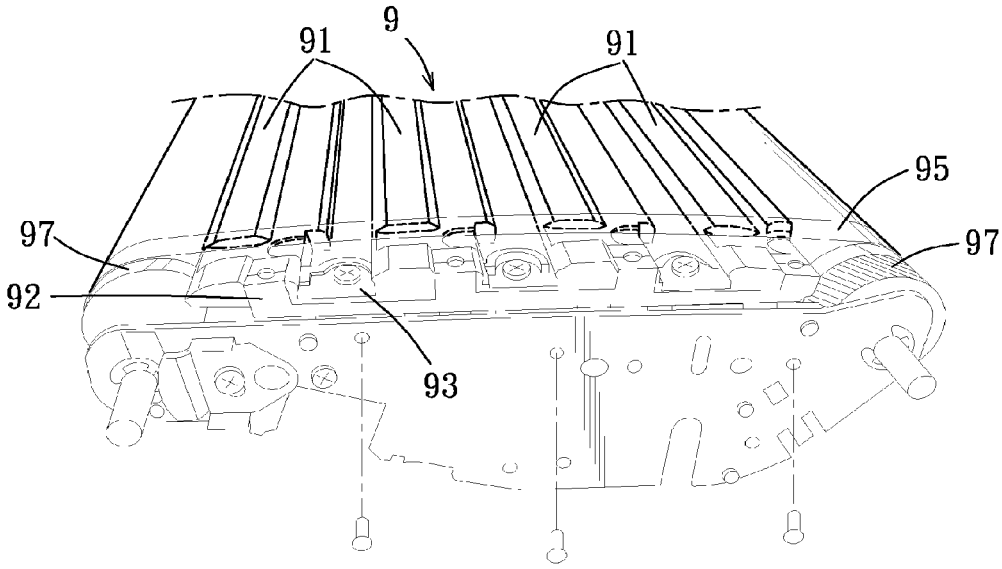
FIG. 2 PRIOR ART
FIG. 2 is a fragmentary perspective view of the conventional organic photoconductor (OPC) drum shown in FIG. 1.
Figure 3:
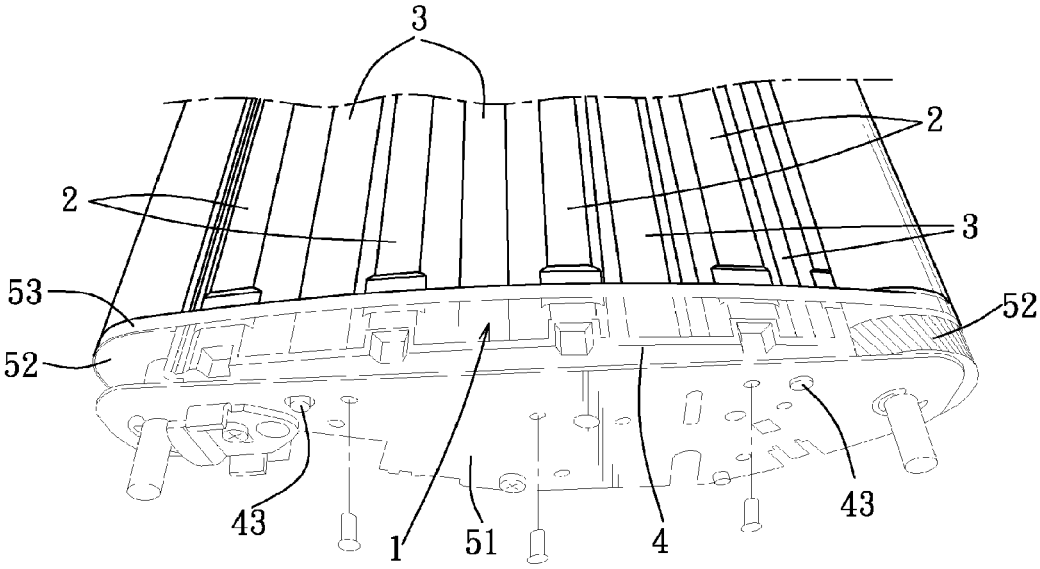
FIG. 3 is a fragmentary perspective view of the preferred embodiment of an organic photoconductor (OPC) drum according to the present invention.
Figure 4:
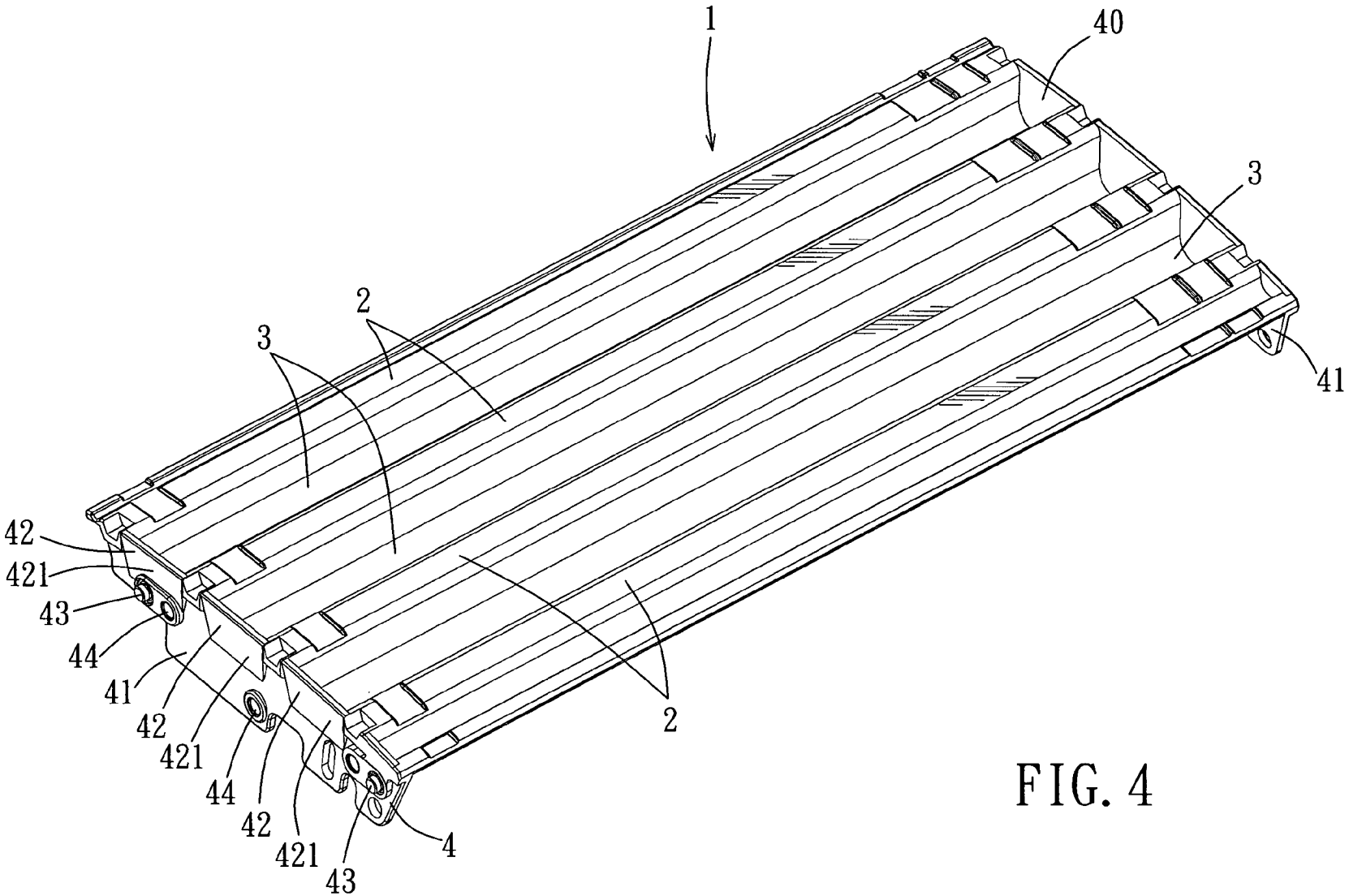
FIG. 4 is a perspective view of a support member of the preferred embodiment.
Figure 5:
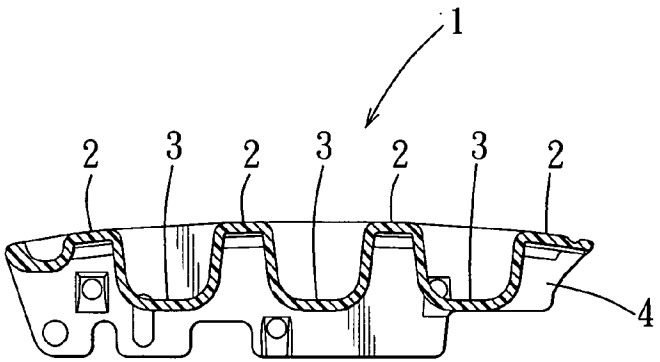
FIG. 5 is a schematic sectional view of the support member of the preferred embodiment.
Figure 6:
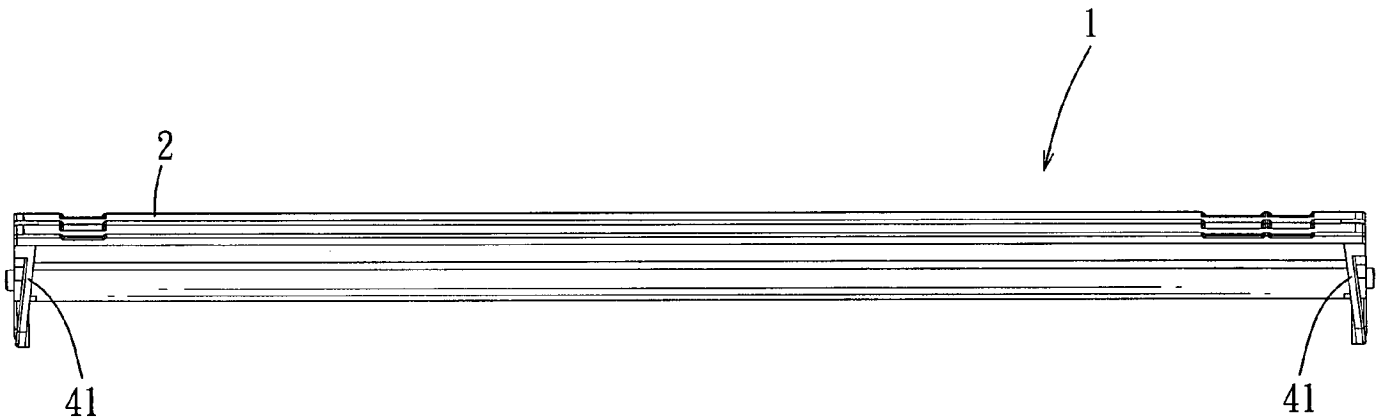
FIG. 6 is a side view of the support member of the preferred embodiment.
Figure 7:
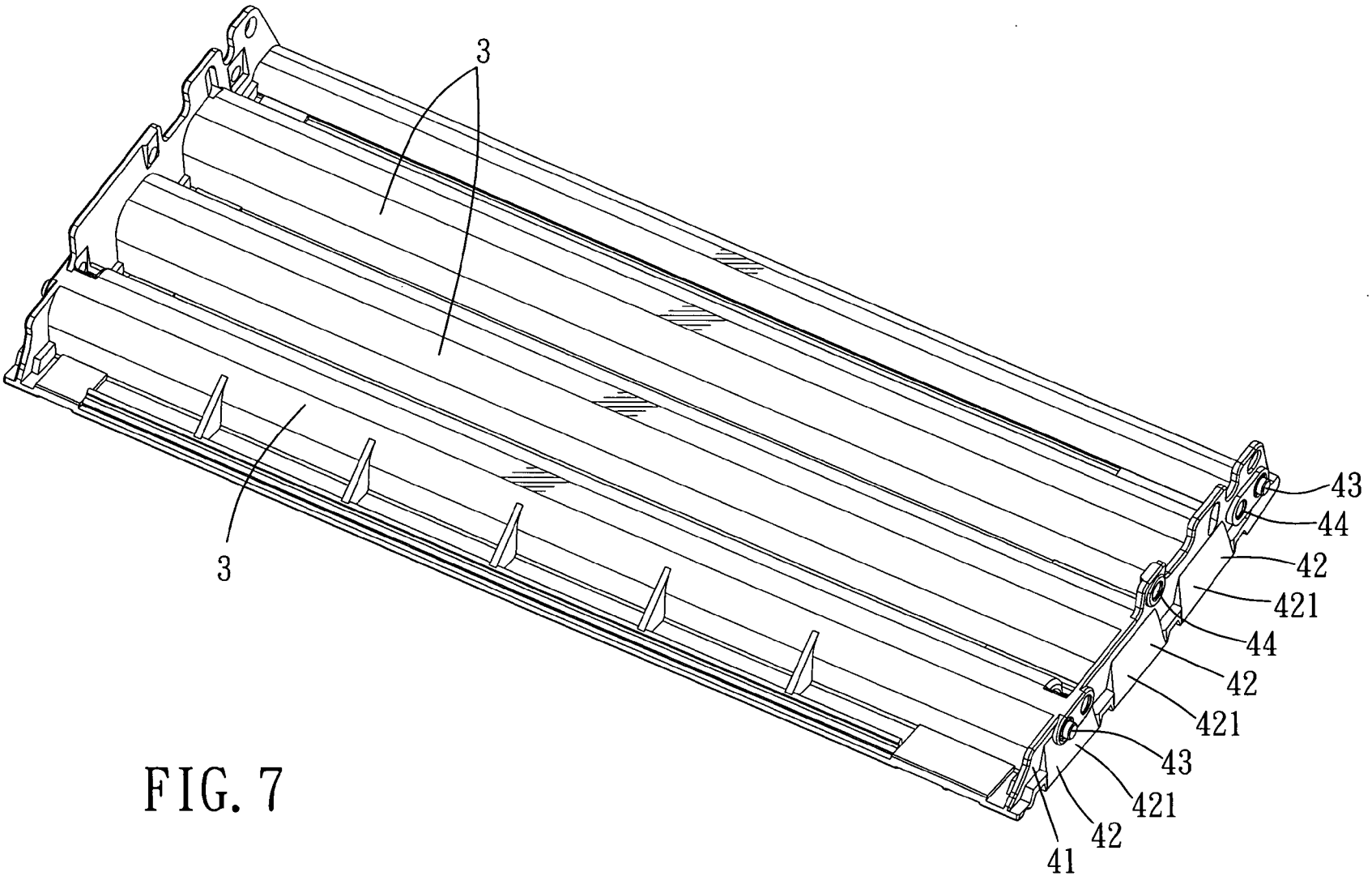
FIG. 7 is a bottom perspective view of the support member of the preferred embodiment.
Figure 8:
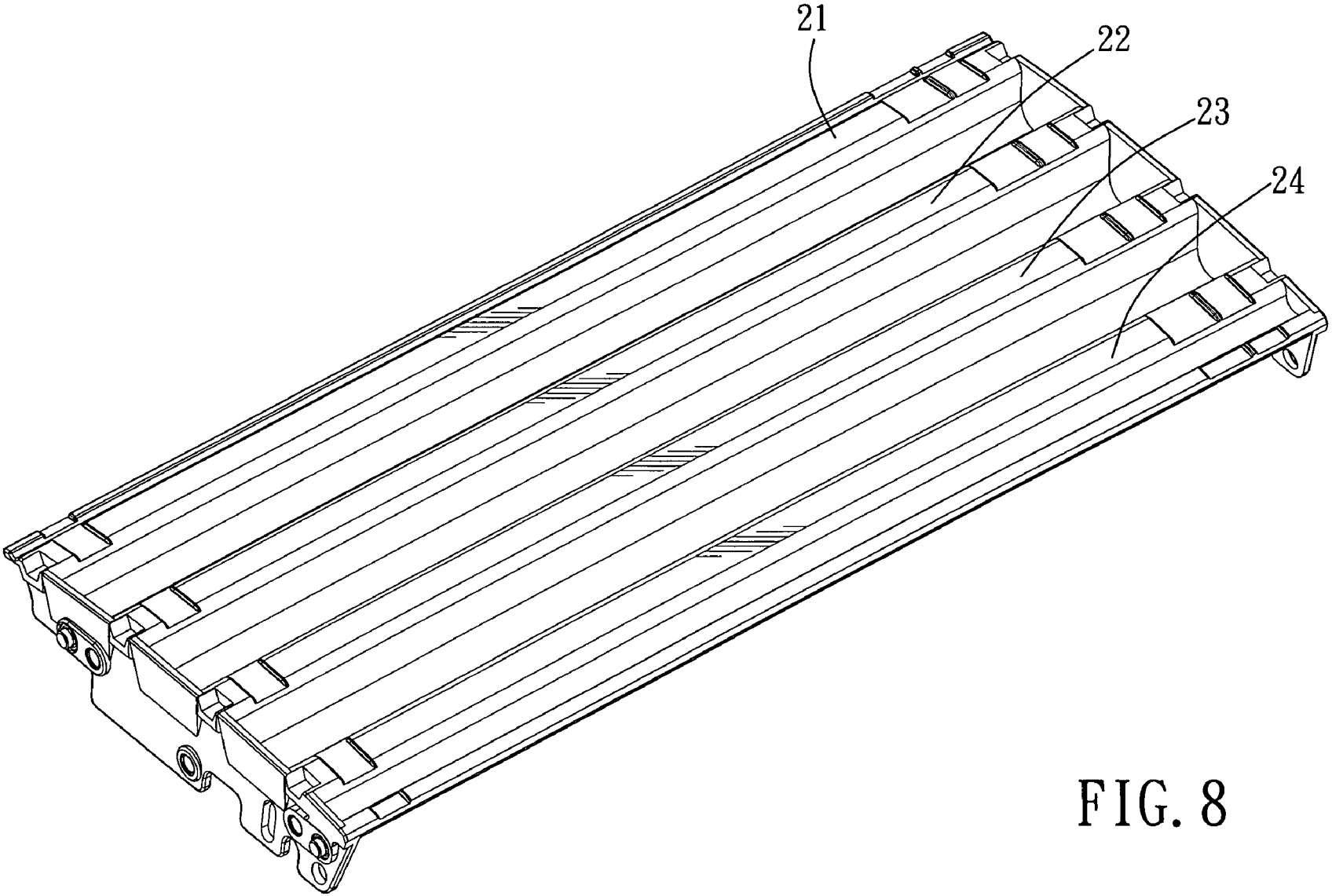
FIG. 8 is a perspective view similar to FIG. 4, illustrating four support plates of the support member.

Referring to FIGS. 3 to 8, the preferred embodiment of an organic photoconductor (OPC) drum according to the present invention includes a support member 1 formed as a unitary molded body, a pair of mounting members 51 (only one is shown in FIG. 3), a pair of rollers 52, and an OPC belt 53. The support member 1 includes a plurality of support plates 2, a plurality of groove-defining U-shaped segments 3, and first and second sidewalls 4, 40. In this embodiment, the support member 1 includes four support plates 2 and three U-shaped segments 3.

Each of the support plates 2 extends in a first direction and has opposite first and second ends. Adjacent ones of the support plates 2 are spaced apart from each other in a second direction transverse to the first direction. Each of the U-shaped segments 3 extends in the first direction, has opposite first and second ends, and interconnects a corresponding adjacent pair of the support plates 2. The first sidewall 4 is connected to the first end of the support plates 2 and the first end of the U-shaped segments 3. The second sidewall 40 is connected to the second end of the support plates 2 and the second end of the U-shaped segments 3.

The mounting members 51 are opposite to each other in the first direction. Each of the mounting members 51 is coupled to a respective one of the first and second sidewalls 4, 40. In this embodiment, each of the first and second sidewalls 4, 40 is formed with positioning pins 43 and fastener holes 44. Each of the mounting members 51 is formed with holes to engage the positioning pins 43 on the corresponding one of the first and second side walls 4, 40, and holes to permit screws to engage the fastener holes 44 in the corresponding one of the first and second side walls 4, 40. The rollers 52 flank the support member 1 in the second direction. Each of the rollers extends in the first direction and has opposite ends coupled to the mounting members 51, respectively. The OPC belt 53 is trained on an assembly of the support member 1 and the rollers 52, and is driven by the rollers 52 to move on the support plates 2 of the support member 1.

In this embodiment, each of the first and second sidewalls 4, 40 has a base part 41 that extends obliquely and outwardly and that has an outer face, and a plurality of block parts 42 that are disposed on the outer face of the base part 41 at positions corresponding to the U-shaped segments 3. In this embodiment, there are three block parts 42 and each of the block parts 42 tapers in a direction away from the support plates 2 and has an inclined face 421 that inclines in a direction opposite to that of the base part 41. Through the design of the base part 41, the block parts 42, and the u-shaped segments 3, residual stress during molding can be reduced to minimize deformation and ensure a uniform surface finish surface across the support plates 2.

Preferably, the support member 1 is formed from a material selected from the group consisting of a bulk molding compound (BMC), a sheet molding compound (SMC), and a thermoplastic material.

In this embodiment, the support member 1 is formed from a bulk molding compound and weights about 200 grams. The bulk molding compound comprises 13 to 15 wt % of unsaturated polyester resin, 10 to 13 wt % of a shrinkage-controlling low profile additive containing polystyrene, 51 to 55 wt % of a filler, and 19 to 21 wt % of glass fibers. The filler is selected from the group consisting of calcium carbonate and aluminum hydroxide.

The following Tables 1 to 3 illustrate variations of surface finishes across the support plates 2 of three samples of the organic photoconductor (OPC) drum of thie invention that are prepared for measurements. Each organic photoconductor (OPC) drum has four support plates 2 (indicated as support plates 21, 22, 23, and 24 in FIG. 8). Measurements were randomly performed on seven different points spaced at regular intervals along the first direction on each of the support plates 21 to 24 with the second and sixth points set as zero reference points. It is to be noted that all measurements are in units of millimeters.

TABLE1

(sample #1)

| Support Plate # | 1 | 2 | 3 | 4 | 5 | 6 | 7 |
|---|---|---|---|---|---|---|---|
| 21 | −0.01208 | 0.000 | −0.002 | 0.000 | −0.004 | 0.000 | 0.01659 |
| 22 | 0.0308 | 0.000 | −0.002 | −0.006 | −0.004 | 0.000 | 0.00474 |
| 23 | 0.03668 | 0.000 | 0.008 | 0.008 | 0.004 | 0.000 | 0.02104 |
| 24 | 0.00208 | 0.000 | −0.014 | −0.018 | −0.014 | 0.000 | −0.0266 |

TABLE 2

(sample #2)

| Support Plate # | 1 | 2 | 3 | 4 | 5 | 6 | 7 |
|---|---|---|---|---|---|---|---|
| 21 | −0.0077 | 0.000 | −0.010 | 0.000 | 0.000 | 0.000 | −0.0012 |
| 22 | 0.0341 | 0.000 | −0.011 | −0.024 | −0.015 | 0.000 | 0.01456 |
| 23 | 0.04412 | 0.000 | −0.015 | −0.025 | −0.018 | 0.000 | 0.0337 |
| 24 | 0.00952 | 0.000 | −0.017 | −0.009 | 0.005 | 0.000 | −0.0139 |

TABLE 3

(sample #3)

| Support Plate # | 1 | 2 | 3 | 4 | 5 | 6 | 7 |
|---|---|---|---|---|---|---|---|
| 21 | −0.0055 | 0.000 | −0.012 | 0.020 | −0.020 | 0.000 | 0.02708 |
| 22 | 0.03494 | 0.000 | −0.001 | −0.005 | −0.007 | 0.000 | 0.00758 |
| 23 | 0.0417 | 0.000 | −0.006 | −0.011 | −0.011 | 0.000 | 0.03519 |
| 24 | −0.00332 | 0.000 | −0.016 | −0.015 | −0.019 | 0.000 | −0.019 |

In view of the above, unlike the conventional organic photoconductor (OPC) drum in which the support member 9 requires many components assembled together and weighs about 970 grams, the support member 1 of the present invention is simply formed as a unitary molded body and weighs about 200 grams. By fabricating the support member 1 as a unitary molded body, manufacturers can realize the benefit of manufacturing the support member 1 that has a uniform surface finish, is high in strength and hardness, and is electrostatic-free and light weight. Ultimately, manufacturing is simplified, production cost is reduced, and production yield is increased accordingly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An organic photoconductor (OPC) drum comprising:

a support member formed as a unitary molded body, said support member including a plurality of support plates, each extending in a first direction and having opposite first and second ends, adjacent ones of said support plates being spaced apart from each other in a second direction transverse to the first direction, a plurality of groove-defining U-shaped segments, each extending in the first direction, having opposite first and second ends, and interconnecting a corresponding adjacent pair of said support plates, and first and second sidewalls, said first sidewall being connected to said first end of said support plates and said first end of said U-shaped segments, said second sidewall being connected to said second end of said support plates and said second end of said U-shaped segments;

a pair of mounting members opposite to each other in the first direction, each of said mounting members being coupled to a respective one of said first and second sidewalls;

a pair of rollers flanking said support member in the second direction, each of said rollers extending in the first direction and having opposite ends coupled to said mounting members, respectively; and an OPC belt trained on an assembly of said support member and said rollers, and driven by said rollers to move on said support plates of said support member;

wherein each of said first and second sidewalls has a base part that extends obliquely and outwardly and that has an outer face, and a plurality of block parts that are disposed on said outer face of said base part at positions corresponding to said U-shaped segments, each of said block parts tapering in a direction away from said support plates and having an inclined face that inclines in a direction opposite to that of said base part.

2. The OPC drum as claimed in claim 1, wherein said support member is formed from a material selected from the group consisting of a bulk molding compound, a sheet molding compound, and a thermoplastic material.

3. The OPC drum as claimed in claim 1, wherein said support member is formed from a bulk molding compound, said bulk molding compound comprising 13 to 15 wt % of unsaturated polyester resin, 10 to 13 wt % of a shrinkage-controlling low profile additive, 51 to 55 wt % of a filler, and 19 to 21 wt % of glass fibers.

4. The OPC drum as claimed in claim 3, wherein said shrinkage-controlling low profile additive contains polystyrene.

5. The OPC drum as claimed in claim 3, wherein said filler is selected from the group consisting of calcium carbonate and aluminum hydroxide.

6. The OPC drum as claimed in claim 1, wherein said support member includes four of said support plates and three of said U-shaped segments.

7. An organic photoconductor (OPC) drum comprising:

a support member formed as a unitary molded body, said support member including a plurality of support plates, each extending in a first direction and having opposite first and second ends, adjacent ones of said support plates being spaced apart from each other in a second direction transverse to the first direction, a plurality of groove-defining U-shaped segments, each extending in the first direction, having opposite first and second ends, and interconnecting a corresponding adjacent pair of said support plates, and first and second sidewalls, said first sidewall being connected to said first end of said support plates and said first end of said U-shaped segments, said second sidewall being connected to said second end of said support plates and said second end of said U-shaped segments;

a pair of mounting members opposite to each other in the first direction, each of said mounting members being coupled to a respective one of said first and second sidewalls;

a pair of rollers flanking said support member in the second direction, each of said rollers extending in the first direction and having opposite ends coupled to said mounting members, respectively; and an OPC belt trained on an assembly of said support member and said rollers, and driven by said rollers to move on said support plates of said support member wherein said support member is formed from a bulk molding compound, said bulk molding compound comprising 13 to 15 wt % of unsaturated polyester resin, 10 to 13wt % of a shrinkage-controlling low profile additive, 51 to 55 wt % of a filler, and 19 to 21 wt % of glass fibers.

8. The OPC drum as claimed in claim 7, wherein said shrinkage-controlling low profile additive contains polystyrene.

9. The OPC drum as claimed in claim 7, wherein said filler is selected from the group consisting of calcium carbonate and aluminum hydroxide.

* * * * *